US008523625B2

(12) United States Patent
Kanemaru et al.

(10) Patent No.: US 8,523,625 B2
(45) Date of Patent: Sep. 3, 2013

(54) METHOD OF MANUFACTURING SPARK PLUG

(75) Inventors: Tomonori Kanemaru, Nagoya (JP); Osamu Yoshimoto, Inazawa (JP); Takaaki Kikai, Iwakura (JP); Masahiro Inoue, Gifu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/606,381

(22) Filed: Sep. 7, 2012

(65) Prior Publication Data

US 2013/0065473 A1 Mar. 14, 2013

(30) Foreign Application Priority Data

Sep. 12, 2011 (JP) ..... 2011-198080

(51) Int. Cl.
*H01J 9/00* (2006.01)

(52) U.S. Cl.
USPC ..... 445/7

(58) Field of Classification Search
USPC ..... 445/7
See application file for complete search history.

(56) References Cited

U.S. PATENT DOCUMENTS 6,707,237 B2 3/2004 Teramura et al. ..... 313/143

FOREIGN PATENT DOCUMENTS

JP 2006-236906 9/2006
JP 03980279 7/2007

*Primary Examiner* — Joseph L Williams
(74) *Attorney, Agent, or Firm* — Kusner & Jaffe

(57) ABSTRACT

A method of manufacturing a spark plug wherein a tip having a burr-free surface is more reliably welded to a ground electrode, to thereby realize an excellent joint strength. The spark plug includes a center electrode, a ground electrode, and a ground-electrode-side tip joined to the ground electrode through its joining surface. The method of manufacturing includes a tip forming step and a tip joining step of resistance-welding the ground-electrode-side tip to the ground electrode. A wire rod having a reference surface is formed, and the wire rod is cut by moving a cutting blade from one edge of the reference surface with respect to the width direction thereof toward the other edge of the reference surface with respect to the width direction, thereby obtaining the ground-electrode-side tip. At least a portion of the reference surface is joined to the ground electrode, whereby that portion becomes the joining surface.

6 Claims, 7 Drawing Sheets

METHOD OF MANUFACTURING SPARK PLUG

FIELD OF THE INVENTION

The present invention relates to a method of manufacturing a spark plug used for an internal combustion engine or the like.

BACKGROUND OF THE INVENTION

A spark plug used for an internal combustion engine or the like includes, for example, a center electrode extending in an axial direction, an insulator provided around the center electrode, a tubular metallic shell provided around the insulator, and a ground electrode joined to a front end portion of the metallic shell. The ground electrode is bent such that its distal end portion faces a front end portion of the center electrode, whereby a spark discharge gap is formed between the front end portion of the center electrode and the distal end portion of the ground electrode.

In recent years, there has been proposed a technique of resistance-welding a tip formed of a metal which is excellent in erosion resistance (e.g., iridium alloy, platinum alloy, or the like) to a part of the distal end portion of the ground electrode, which part forms the spark discharge gap, to thereby improve not only ignition performance but also erosion resistance (see, for example, Japanese Patent No. 3980279 "Patent Document 1", etc.).

SUMMARY OF THE INVENTION

Problems to be Solved by the Invention

Incidentally, the tip can be obtained by shear-cutting a wire rod obtained through a forging process or the like to a predetermined length by means of a cutting blade. As a result of such cutting, a so-called burr may be formed at the end of the tip on the cut face side. If the tip is welded to the ground electrode such that the end surface having a burr is joined to the ground electrode, the burr decreases the joint strength between the tip and the ground electrode, and oxidation scale becomes likely to be formed at the interface between the tip and the ground electrode. If such oxidation scale grows, the tip is likely to separate (come off) due to, for example, vibration generated as a result of operation of the internal combustion engine or the like.

Particularly, in a recent engine of a high output, high compression type, the temperature within the combustion chamber is higher than that in a conventional engine. Therefore, oxidation scale is more likely to grow at the abovementioned interface. Also, vibrations which act on the ground electrode and the tip as a result of operation of the engine are apt to increase. Accordingly, in such an engine, there is greater concern for separation (coming off) of the tip.

The present invention has been accomplished in view the above-described problem, and its object is to provide a method of manufacturing a spark plug which enables a burr-free surface of a tip to be welded to a ground electrode more reliably, to thereby realize excellent joint strength.

Means for Solving the Problems

Configurations suitable for achieving the above object will next be described in itemized form. If needed, actions and effects peculiar to the configurations will be additionally described.

Configuration 1. A method of manufacturing a spark plug of the present configuration is used for manufacturing a spark plug which comprises:

a center electrode extending in a direction of an axis;

a tubular insulator provided around the center electrode;

a tubular metallic shell provided around the insulator;

a rod-like ground electrode joined to a front end portion of the metallic shell; and a tip joined to the ground electrode through a joining surface of the tip, the tip forming a gap between the tip and a front end portion of the center electrode.

The method is characterized by comprising a tip forming step of forming the tip, and a tip joining step of resistance-welding the tip to the ground electrode, wherein the tip forming step includes:

a wire rod forming step of forming a wire rod which is formed of the same metal as that of the tip, which has a rectangular cross section, and which has a reference surface on its side surface, and a wire rod cutting step of cutting the wire rod by moving a predetermined cutting blade from one edge of the reference surface with respect to a width direction thereof toward the other edge of the reference surface with respect to the width direction, to thereby obtain the tip, wherein in the tip joining step, at least a portion of the reference surface of the tip is joined to the ground electrode, whereby the portion of the reference surface becomes the joining surface.

According to configuration 1 mentioned above, in the wire rod cutting step, the wire rod is cut by moving the cutting blade from one edge of the reference surface with respect to the width direction thereof toward the other edge of the reference surface with respect to the width direction, whereby the tip is obtained. Accordingly, of the side surfaces of the tip, the reference surface has no burr although burrs may be formed on a side surface adjacent to the reference surface. In the tip joining step, the reference surface of the tip is joined to the ground electrode, whereby a surface of the tip on which no burr is formed can be joined to the ground electrode. As a result, the joint strength between the tip and the ground electrode can be increased, whereby separation of the tip can be prevented more reliably.

Configuration 2. A method of manufacturing a spark plug of the present configuration is characterized in that in configuration 1 mentioned above, the tip has a rectangular cross section whose two edges have a length different from that of the remaining edges.

According to configuration 2 mentioned above, the reference surface of the wire rod can be readily distinguished from the remaining side surfaces of the wire rod. Accordingly, in the wire rod cutting step, erroneous determination of the cutting direction of the wire rod can be prevented more reliably. Also, in the tip joining step, the reference surface of the tip can be joined to the ground electrode more reliably.

Configuration 3. A method of manufacturing a spark plug of the present configuration is characterized in that in configuration 1 or 2 mentioned above, the tip has a shape of a rectangular parallelepiped, and, in the wire rod cutting step, the wire rod is cut such that edges perpendicular to the cross section have a length different from the width of the reference surface.

The reference surface of the tip has a rectangular shape which has edges X having a length equal to the width of the reference surface and edges Z perpendicular to the edges X. Also, in the case where the tip is formed by the method of the above-described configuration 1, burrs are formed such that they project from a surface which has the edges Z and edges Y perpendicular to both the edges X and the edges Z. In the case where the reference surface of the tip is joined to a side surface of the ground electrode, the burrs may project in the longitudinal direction of the ground electrode or project in a direction perpendicular to the longitudinal direction of the ground electrode, depending on the direction of the tip (more specifically, when the tip is joined such that a surface having the edges Y and Z perpendicularly intersects the longitudinal direction of the ground electrode, the burrs project in the longitudinal direction of the ground electrode, and when the tip is joined such that the surface having the edges Y and Z becomes parallel to the longitudinal direction of the ground electrode, the burrs project in a direction perpendicular to the longitudinal direction of the ground electrode).

In a spark plug of a type (a so-called lateral discharge type or oblique discharge type) in which spark discharge occurs in a direction intersecting the axis (the spark discharge has a vector), if burrs project in the longitudinal direction of the ground electrode, the burrs may be located on the gap side. The size of the gap varies between the case where burrs are present on the gap side and the case where no burr is present on the gap side. Therefore, ignition performance may vary among spark plugs.

In order to suppress such variation of ignition performance, it is desired to join the tip such that the burrs project in a direction perpendicular to the longitudinal direction of the ground electrode and are not present on the gap side. However, in the case where the length of the edges X is rendered the same as that of the edges Z, the direction of the tip at the time of welding cannot be adjusted on the basis of the lengths of the edges of the tip.

In contrast, according to configuration 3 mentioned above, in the wire rod cutting step, the wire rod is cut such that the edges perpendicular to the cross section have a length different from the width of the reference surface. According, in the obtained tip, the length of the edges X differs from that of the edges Z. Therefore, the direction of the tip at the time of welding can be adjusted on the basis of the lengths of the edges. Thus, it becomes possible to more reliably dispose the tip such that burrs are not present on the gap side. As a result, it becomes possible to more reliably prevent occurrence of a situation in which ignition performance varies among spark plugs.

Configuration 4. A method of manufacturing a spark plug of the present configuration is characterized in that in configuration 2 mentioned above, the tip is formed such that, of the four edges of the cross section, two edges having a length equal to the width of the reference surface are longer than the remaining edges.

According to configuration 4 mentioned above, a portion of the tip, which portion has a sufficiently large width (corresponding to the length of the edges X), can be joined to the ground electrode without excessively increasing the thickness of the tip (corresponding to the length of the edges Y). Accordingly, it is possible to further increase welding strength while reducing manufacturing cost.

Also, in the case where the tip is joined to a side surface of the ground electrode such that a portion of the tip projects from the distal end of the ground electrode in the longitudinal direction of the ground electrode, at the time of resistance welding, the electric field strength increases at the edge portion located between the distal end surface of the ground electrode and the side surface of the ground electrode to which the tip is joined. Therefore, a portion of the tip corresponding to the edge portion is strongly joined to the ground electrode. Accordingly, in the case where the tip is joined in this manner, the above-described configuration 4 further increases the joint strength, because the width of the portion of the tip corresponding to the above-mentioned edge portion (corresponding to the length of the edges X) can be increased.

Configuration 5. A method of manufacturing a spark plug of the present configuration is characterized in that in any of configurations 1 to 4 mentioned above, the tip has a shape of a rectangular parallelepiped, and the difference in length among the edges is equal to or greater than 0.05 mm.

According to configuration 5 mentioned above, the difference in length among the edges of the tip is made equal to or greater than 0.05 mm. Accordingly, in a manufacturing apparatus, the reference surface of the tip can be identified more accurately. As a result, a burr-free surface (the reference surface) of the tip can be joined to the ground electrode more reliably.

Configuration 6. A method of manufacturing a spark plug of the present configuration is characterized in that in any of configurations 1 to 5 mentioned above, in the tip joining step, a portion of the reference surface of the tip is joined to the ground electrode in a state in which the tip projects from a distal end of the ground electrode in a longitudinal direction of the ground electrode.

In the case where the tip is joined to the ground electrode in a state in which the tip projects from the distal end of the ground electrode in the longitudinal direction of the ground electrode as in the abovementioned configuration 6, the area of the joint of the tip to the ground electrode is relatively small, and vibration generated as a result of operation of an internal combustion engine is apt to act on the tip. Therefore, separation of the tip is worried. However, through employment of the above-described configuration 1, etc., such worry can be eliminated. In order words, the above-described configuration 1, etc are particularly meaningful in the case where the tip is joined to the ground electrode in a state in which the tip projects from the distal end of the ground electrode in the longitudinal direction of the ground electrode.

DETAILED DESCRIPTION OF THE INVENTION

Figure 1:
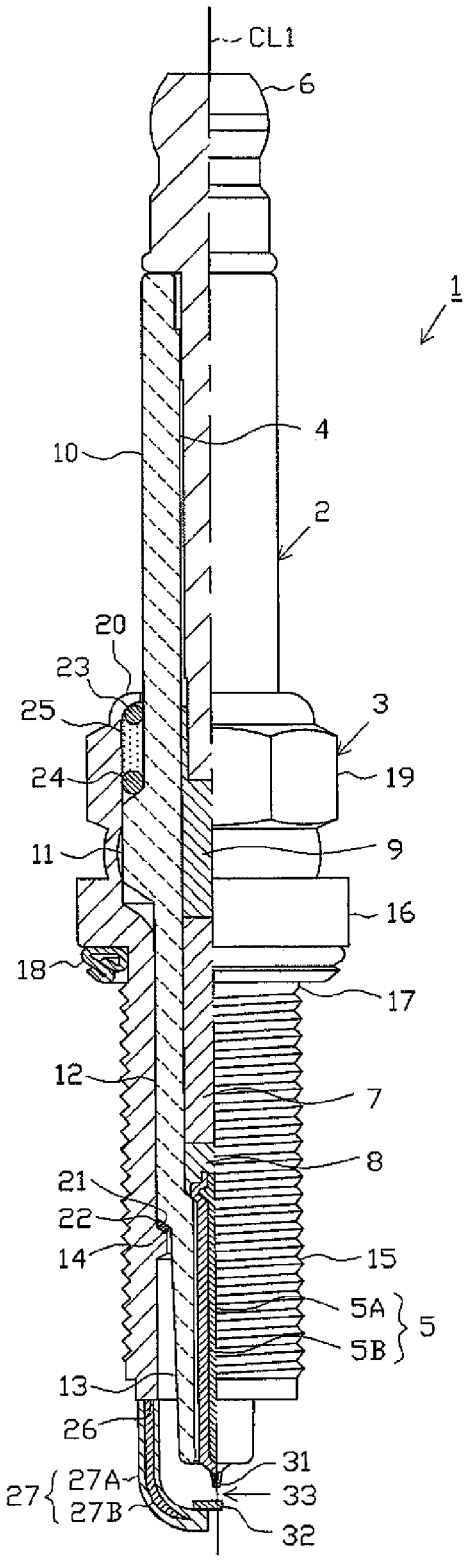
FIG. 1 is a partially sectioned front view showing the configuration of a spark plug.

An embodiment of the present invention will next be described with reference to the drawings. FIG. 1 is a partially sectioned front view showing a spark plug 1. In the following description, the direction of an axis CL1 of the spark plug 1 in FIG. 1 is referred to as the vertical direction, and the lower side of the spark plug 1 in FIG. 1 is referred to as the front end side of the spark plug 1, and the upper side as the rear end side of the spark plug 1.

The spark plug 1 includes a tubular insulator 2, and a tubular metallic shell 3, which holds the insulator 2.

The insulator 2 is formed from alumina or the like by firing, as well known in the art. The insulator 2 externally includes a rear trunk portion 10 formed on the rear end side; a large-diameter portion 11, which is located frontward of the rear trunk portion 10 and projects radially outward; an intermediate trunk portion 12, which is located front-ward of the large-diameter portion 11 and is smaller in diameter than the large-diameter portion 11; and a leg portion 13, which is located frontward of the intermediate trunk portion 12 and is smaller in diameter than the intermediate trunk portion 12. Of the insulator 2, the large-diameter portion 11, the intermediate trunk portion 12, and most of the leg portion 13 are accommodated in the metallic shell 3. A tapered, stepped portion 14 is formed at a connection portion between the intermediate trunk portion 12 and the leg portion 13. The insulator 2 is seated on the metallic shell 3 via the stepped portion 14.

The insulator 2 has an axial hole 4 extending therethrough along the axis CL1. A center electrode 5 is fixedly inserted into a front end portion of the axial hole 4. The center electrode 5 includes an inner layer 5A and an outer layer 5B. The inner layer 5A is formed of a metal which is excellent in thermal conductivity (e.g., copper, copper alloy, or the like). The outer layer 5B is formed of an Ni alloy which contains nickel (Ni) as a main component. The center electrode 5 assumes a rod-like (circular columnar) shape as a whole; has a flat front end surface; and projects from the front end of the insulator 2. Also, a circular columnar center-electrode-side tip 31 formed of a metal which is excellent in erosion resistance (e.g., platinum alloy or iridium alloy) is provided at the front end of the center electrode 5.

A terminal electrode 6 is fixedly inserted into a rear end portion of the axial hole 4 and projects from the rear end of the insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6 via conductive glass seal layers 8 and 9, respectively.

The metallic shell 3 is formed of a metal such as low-carbon steel and has a tubular shape. The metallic shell 3 has a threaded portion (externally threaded portion) 15 on its outer circumferential surface, and the threaded portion 15 is used to mount the spark plug 1 to a mounting hole of a combustion apparatus (e.g., an internal combustion engine, a fuel cell reformer, or the like). A seat portion 16 projecting radially outward is formed on the outer circumferential surface and located rearward of the threaded portion 15. A ring-like gasket 18 is fitted to a screw neck 17 located at the rear end of the threaded portion 15. The metallic shell 3 also has a tool engagement portion 19 provided near its rear end. The tool engagement portion 19 has a hexagonal cross section and allows a tool such as a wrench to be engaged therewith when the metallic shell 3 is to be mounted to the combustion apparatus. Further, the metallic shell 3 has a crimp portion 20 provided at its rear end portion and adapted to hold the insulator 2.

The metallic shell 3 has a tapered, stepped portion 21 provided on its inner circumferential surface and adapted to allow the insulator 2 to be seated thereon. The insulator 2 is inserted frontward into the metallic shell 3 from the rear end of the metallic shell 3. In a state in which the stepped portion 14 of the insulator 2 butts against the stepped portion 21 of the metallic shell 3, a rear-end opening portion of the metallic shell 3 is crimped radially inward; i.e., the crimp portion 20 is formed, whereby the insulator 2 is fixed to the metallic shell 3. An annular sheet packing 22 intervenes between the stepped portions 14 and 21. This retains gastightness of a combustion chamber and prevents leakage of a fuel gas to the exterior of the spark plug 1 through a clearance between the inner circumferential surface of the metallic shell 3 and the leg portion 13 of the insulator 2, which leg portion 13 is exposed to the combustion chamber.

In order to ensure gastightness which is established by crimping, annular ring members 23 and 24 intervene between the metallic shell 3 and the insulator 2 in a region near the rear end of the metallic shell 3, and a space between the ring members 23 and 24 is filled with powder of talc 25. That is, the metallic shell 3 holds the insulator 2 via the sheet packing 22, the ring members 23 and 24, and the talc 25.

Figure 2:
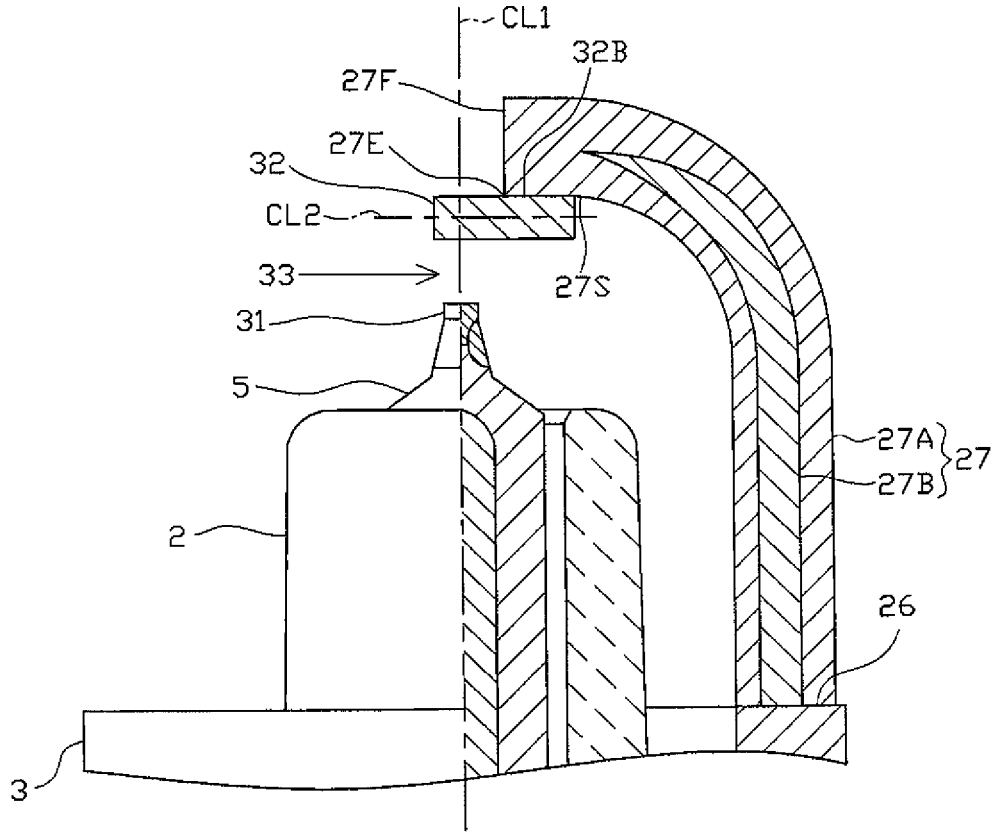
FIG. 2 is a partially sectioned, enlarged front view showing the configuration of a front end portion of the spark plug.

As shown in FIG. 2, a ground electrode 27 is joined to a front end portion 26 of the metallic shell 3. Specifically, the ground electrode 27 is bent, at its intermediate portion, toward the center electrode 5 side, and has a rectangular cross section. The ground electrode 27 includes an outer layer 27A and an inner layer 27B. The outer layer 27A is formed of an Ni alloy [e.g., INCONEL 600 or INCONEL 601 (registered trademark)]. The inner layer 27B is formed of a metal (e.g., copper, copper alloy, or the like) which is superior in thermal conductivity to the above-mentioned Ni alloy.

A ground-electrode-side tip 32(which corresponds to the "tip" of the present invention) formed of a metal which is excellent in erosion resistance (e.g., an iridium alloy, a platinum alloy, or the like) is joined to a side surface 27S of the ground electrode 27 located on the side toward the center electrode 5. More specifically, the ground electrode-side tip 32 is resistance-welded to the ground electrode 27 through a joining surface 32B, which is provided on its side surface, in a state in which a portion of the ground-electrode-side tip 32 projects from a distal end surface 27F of the ground electrode 27 in the longitudinal direction of the ground electrode 27. A spark discharge gap 33 is formed between a side surface of the ground-electrode-side tip 32 opposite the joining surface 32B and the front end surface of the center electrode 5(the center-electrode-side tip 31). Spark discharge occurs at the spark discharge gap 33 in a direction parallel to the axis CL1.

Figure 3:
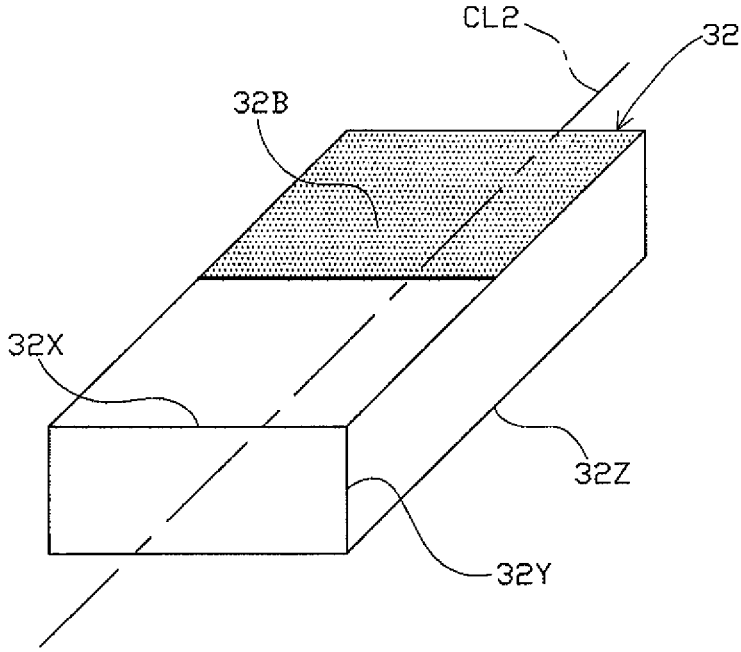
FIG. 3 is an enlarged perspective view showing the configuration of a ground electrode-side tip.

As shown in FIG. 3 (in FIG. 3, the ground electrode 27 is not illustrated), the ground-electrode-side tip 32 has the shape of a parallelepiped. It has edges 32X which are located on the side toward the joining surface 32B (a portion with dots in FIG. 3) and which have a length equal to the width of a reference surface BS to be described later; edges 32Y perpendicularly intersecting the edges 32X; and edges 32Z which perpendicularly intersect the edges 32X and 32Y and which extend in the direction of the center axis CL2 of the ground-electrode-side tip 32. The difference in length among the edges 32X, 32Y, and 32Z is set to 0.05 mm or greater. Accordingly, as viewed on a cross section orthogonally intersecting the center axis CL2 of the ground-electrode-side tip 32, the ground-electrode-side tip 32 has a rectangular cross section whose two edges have a length different from those of the remaining edges, and the length of the edges 32Z orthogonal to the cross section differs from the length of the edges 32X (the width of the reference surface BS) (in the present embodiment, the length of the edges 32Z is greater than that of the edges 32X).

Furthermore, in the present embodiment, the length of the edges 32X is rendered greater than the length of the edges 32Y. That is, of the four edges of the cross section, the edges whose length is equal to the width of the reference surface BS are rendered longer than the remaining edges. Therefore, a portion (portion indicated by a thick line in FIG. 3) of the ground-electrode-side tip 32, which portion is joined to an edge portion 27E (see FIG. 2) of the ground electrode 27 located between the distal end surface 27F and the side surface 27S thereof, has a relatively large width.

Next, a method of manufacturing the spark plug 1 configured as mentioned above will be described.

First, the metallic shell 3 is formed beforehand. Specifically, a circular columnar metal material (e.g., an iron-based material or a stainless steel material) is subjected to cold forging or the like so as to form a general shape, and a through hole is then formed. Subsequently, machining is conducted so as to adjust the outline, thereby yielding a metallic-shell intermediate.

Subsequently, the ground electrode 27 formed of an Ni alloy or the like and having the shape of a straight rod is resistance-welded to the front end surface of the metallic-shell intermediate. The resistance welding is accompanied by formation of so called "sags." After the "sags" are removed, the threaded portion 15 is formed in a predetermined region of the metallic-shell intermediate by rolling. Thus, the metallic shell 3 to which the ground electrode 27 has been welded is obtained. The metallic shell 3 to which the ground electrode 27 has been welded is subjected to galvanization or nickel plating. In order to enhance corrosion resistance, the plated surface may be further subjected to chromate treatment.

Separately from preparation of the metallic shell 3, the insulator 2 is formed. For example, a forming material granular-substance is prepared by use of a material powder which contains alumina in a predominant amount, a binder, etc. By use of the prepared forming material granular-substance, a tubular green compact is formed by rubber press forming. The thus-formed green compact is subjected to grinding for shaping the obtained green compact. The shaped green compact is placed in a kiln, followed by firing, thereby yielding the insulator 2.

Separately from preparation of the metallic shell 3 and the insulator 2, the center electrode 5 is manufactured. Specifically, an Ni alloy prepared such that a copper alloy or the like is disposed in a central portion thereof for enhancing heat radiation is subjected to forging, thereby forming the center electrode 5. Further, the center-electrode-side tip 31 is joined to a front end portion of the center electrode 5 by laser welding, or the like.

Next, the insulator 2 and the center electrode 5, which are formed as mentioned above, the resistor 7, and the terminal electrode 6 are fixed in a sealed condition by means of the glass seal layers 8 and 9. In general, these glass seal layers 8 and 9 are formed of a mixture of borosilicate glass and metal powder. Specifically, the mixture is charged into the axial hole 4 of the insulator 2 such that the resistor 7 is sandwiched between layers of the mixture. Then, in a state in which the charged mixture is pressed by the terminal electrode 6 from the rear side, the resultant assembly is heated in a kiln so as to fire the mixture. In this heating process within the kiln, glaze applied to the surface of the rear trunk portion 10 of the insulator 2 may be simultaneously fired so as to form a glaze layer. Alternatively, the glaze layer may be formed beforehand.

Subsequently, the thus-formed insulator 2 having the center electrode 5 and the terminal electrode 6, and the metallic shell 3 having the ground electrode 27 are fixed together. More specifically, after the insulator 2 is inserted into the metallic shell 3, a relatively thin-walled rear-end opening portion of the metallic shell 3 is crimped radially inward; i.e., the above-mentioned crimp portion 20 is formed, thereby fixing the insulator 2 and the metallic shell 3 together.

Figure 4:
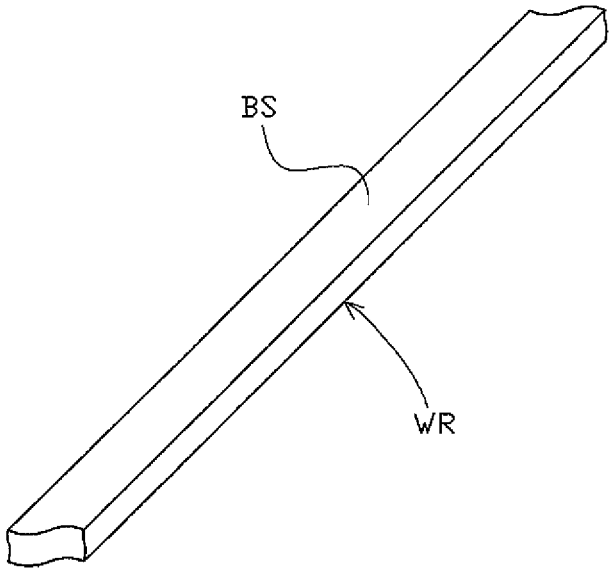
FIG. 4 is an enlarged perspective view showing the configuration of a wire rod.

Also, the ground-electrode-side tip 32 is formed in a tip forming step, which is a step different from the steps of forming the metallic shell 3, etc. The tip forming step includes a wire rod forming step and a wire rod cutting step. In the wire rod forming step, a wire rod WR is manufactured. As shown in FIG. 4, the wire rod WR has a rectangular cross section and has a flat reference surface BS on one side thereof. Specifically, an ingot formed of the same metal as that of the ground-electrode-side tip 32 is prepared, and hot forging and hot rolling (grooved roll rolling) are performed on the ingot, followed by drawing. Thus, the above-mentioned wire rod WR is obtained. As viewed on a cross section of the wire rod WR taken perpendicular to the longitudinal direction thereof, the wire rod WR has a rectangular cross section whose two edges have a length different from that of the remaining two edges. The width of the reference surface BS is at least 0.05 mm greater than the width of side surfaces adjacent thereto.

Figure 5:
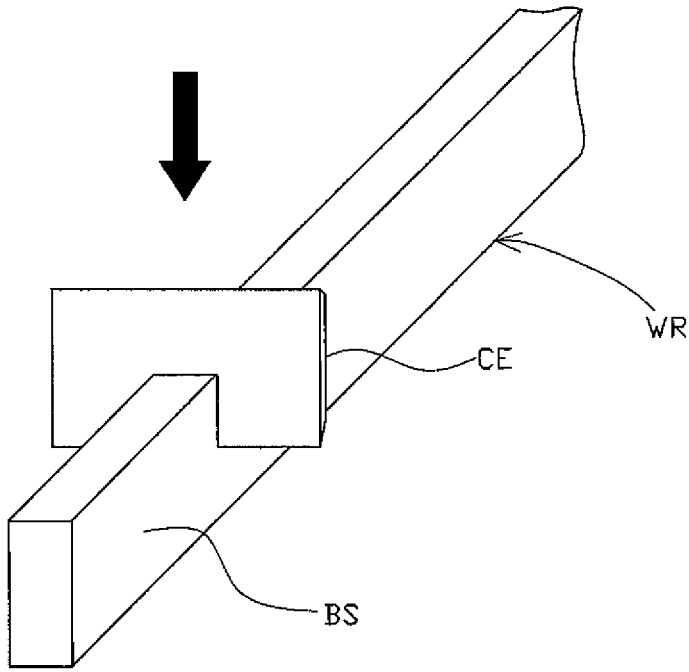
FIG. 5 is an enlarged perspective view showing a wire rod and a cutting blade in a wire cutting step.
Figure 6:
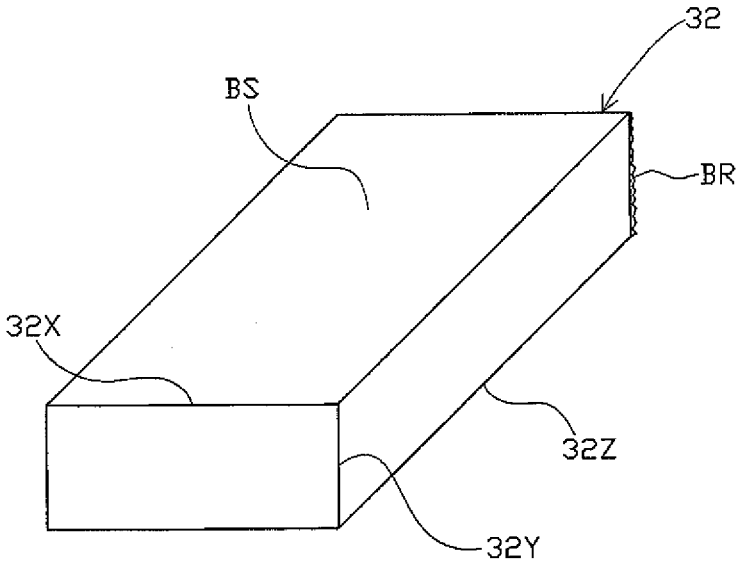
FIG. 6 is a perspective view showing the configuration of a ground-electrode side tip obtained by a tip forming step.
Figure 7:
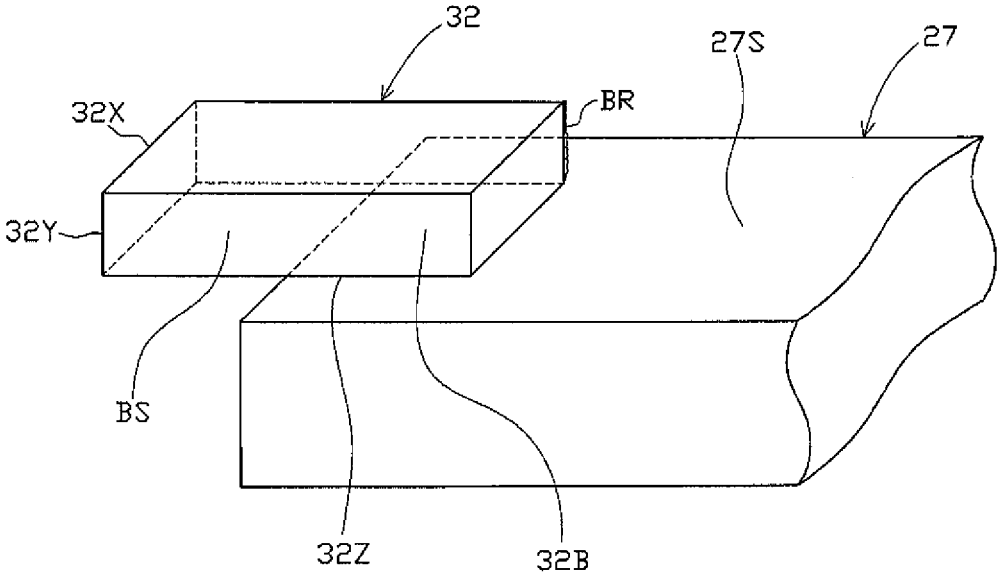
FIG. 7 is an enlarged perspective view showing the ground-electrode-side tip, etc. in a tip joining step.

Next, in the wire rod cutting step, as shown in FIG. 5, the wire rod WR is cut by a predetermined cutting blade CE to a predetermined length, whereby the ground electrode-side tip 32 is obtained. More specifically, first, the wire rod WR is disposed such that, of the side surfaces of the wire rod WR, one side surface adjacent to the reference surface BS faces the cutting blade CE. Since the width of the reference surface BS differs from the width of the side surfaces adjacent thereto as described above, confusing the reference surface BS with the side surfaces adjacent thereto is prevented, whereby the wire rod WR is disposed in the above-described orientation without fail. After the wire rod WR is disposed, the cutting blade CE is moved from one edge of the reference surface BS with respect to the width direction thereof toward the other edge of the reference surface BS so as to cut the wire rod WR. As a result, as shown in FIG. 6, the ground-electrode-side tip 32 is obtained. Notably, when the wire rod WR is cut, the cutting position of the wire rod WR is set such that the length of the obtained ground electrode-side tip 32 (corresponding to the length of the edges 32Z) differs from the width of the reference surface BS and the width of the side surfaces adjacent thereto by an amount of 0.05 mm or greater. Also, burrs BR are formed on a side surface of the obtained ground-electrode-side tip 32 different from the reference surface BS. The burrs BR project in the direction in which the cutting blade CE is advanced.

Next, in the tip joining step, the ground-electrode-side tip 32 is joined to the front end of the ground electrode 27. Specifically, the reference surface BS of the ground-electrode-side tip 32 is identified by a predetermined parts feeder (not shown), and the ground-electrode-side tip 32 is disposed on the side surface 27S of the ground electrode 27 by the parts feeder such that a portion of the reference surface BS (i.e., a surface on which the burrs BR do not exist) of the ground-electrode-side tip 32 is in contact with the side surface 27S. Subsequently, a predetermined welding rod (not shown) is brought into contact with the surface of the ground-electrode-side tip 32 opposite the reference surface BS, and is caused to press the ground-electrode-side tip 32 with a predetermined pressure. In this state, a predetermined current is caused to flow from the welding rod to the ground electrode-side tip 32. As a result, there is formed a fusion zone (not shown) where the metal which constitutes the ground electrode 27 and the metal which constitutes the ground-electrode-side tip 32 fuse together, whereby the ground-electrode-side tip 32 is joined to the ground electrode 27. Notably, as a result of joining, a portion of the reference surface BS of the ground-electrode-side tip 32 becomes the joining surface 32B.

Finally, the ground electrode 27 is bent toward the center electrode 5 side, and the size of the spark discharge gap 33 formed between the center electrode 5 (the center-electrode-side tip 31) and the ground-electrode-side tip 32 is adjusted, whereby the above described spark plug 1 is completed.

As described above, according to the present embodiment, in the wire rod cutting step, the cutting blade CE is moved from one edge of the reference surface BS with respect to the width direction thereof toward the other edge of the reference surface BS so as to cut the wire rod WR, to thereby produce the ground-electrode-side tip 32. Accordingly, no burr is formed on the reference surface BS of the ground-electrode-side tip 32. In the tip joining step, the reference surface BS of the ground-electrode-side tip 32 is joined to the ground electrode 27. Thus, a surface of the ground-electrode-side tip 32 on which the burrs BR are not formed can be joined to the ground electrode 27. As a result, the joint strength between the ground-electrode-side tip 32 and the ground electrode 27 can be increased, whereby separation of the ground-electrode-side tip 32 can be more reliably prevented.

Also, in the present embodiment, the ground-electrode-side tip 32 has a rectangular cross section whose two edges have a length different from that of the remaining two edges. Namely, the width of the reference surface BS is rendered different from the width of the side surfaces adjacent thereto. Accordingly, in the wire rod WR, the reference surface BS can be readily distinguished from the remaining side surfaces. Therefore, in the wire rod cutting step, erroneous determination of the cutting direction of the wire rod WR can be prevented more reliably. Also, in the tip joining step, the reference surface BS of the ground-electrode-side tip 32 can be joined to the ground electrode 27 more reliably.

Furthermore, in the present embodiment, the length of the edges 32X is rendered greater than the length of the edges 32Y. Accordingly, a portion of the ground-electrode side tip 32, which portion has a sufficiently large width (corresponding to the length of the edges 32X), can be joined to the ground electrode 27 without excessively increasing the thickness of the ground-electrode-side tip 32 (corresponding to the length of the edges 32Y). Accordingly, it is possible to further increase welding strength while reducing manufacturing cost. Also, since the width of a portion of the ground-electrode-side tip 32 corresponding to the edge portion 27E of the ground electrode 27 can be increased, the joint strength can be increased further.

Additionally, the difference in length among the edges 32X, 32Y, and 32Z of the ground-electrode-side tip 32 is rendered equal to or greater than 0.05 mm. Accordingly, a production apparatus (parts feeder) can identify the reference surface BS of the ground electrode-side tip 32 more accurately. As a result, the surface (the reference surface BS) of the ground-electrode-side tip 32 on which the burrs BR are not formed can be joined to the ground electrode 27 more reliably.

Figure 8:
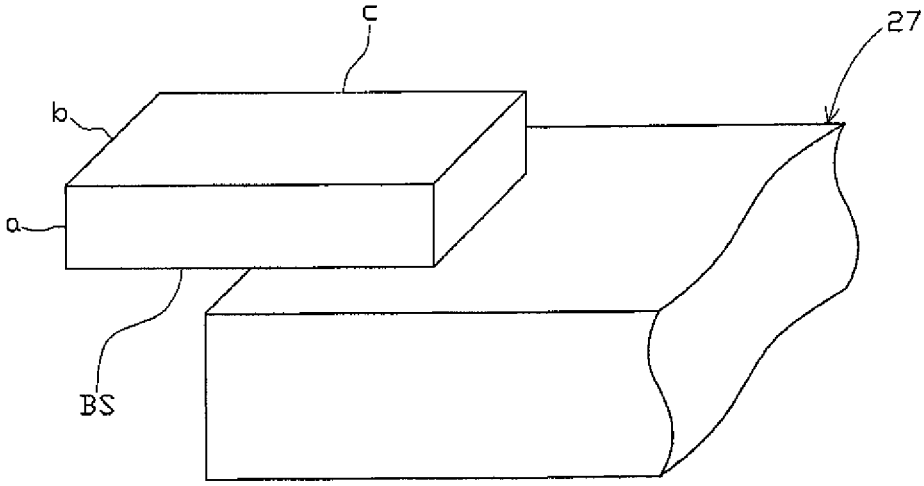
FIG. 8 is an enlarged perspective view showing the configuration of a sample used in a bench burner test.

Next, a bench burner test was carried out in order to confirm the action and effect achieved by the above-described embodiment. The outline of the bench burner test is as follows. First, ground-electrode-side tips differing from one another in the lengths of the three edges a, b, and c (shown in FIG. 8) were produced through a process of cutting a wire rod by moving a cutting blade from the reference surface side toward the side opposite the reference surface (case A; corresponding to Comparative Example) or a process of cutting a wire rod by moving the cutting blade from one edge of the reference surface with respect to the width direction toward the other edge of the reference surface (case B; corresponding to Example). The reference surface BS of each obtained ground electrode-side tip was joined to a distal end portion of the ground electrode, whereby a sample of the ignition plug was manufactured. Next, each sample was subjected to 1,000 heat cycles each including a two-minute heating period in which the sample was heated by a burner such that the temperature of the distal end portion of the ground electrode became 1,000±20° C. (that is, under a condition more severe than an ordinary condition (about 900° C.)), and a one-minute cooling period in which the sample was gradually cooled. After completion of the 1,000 heat cycles, the cross section of the interface between the ground electrode and the ground-electrode-side tip was observed, and the ratio (oxidation free ratio) of the length of a portion of the interface where no oxidation scale was formed to the entire length of the interface was measured. A sample having an oxidation free ratio of 60% or greater was evaluated "Excellent" because the sample is excellent in terms of the joint strength between the ground-electrode-side tip and the ground electrode. In contrast, a sample having an oxidation free ratio less than 60% was evaluated "Poor" because the sample is slightly poor in terms of the joint strength. Table 1 shows the results of the test. In all the samples, the ground-electrode-side tip was resistance-welded to the ground electrode under the same conditions.

TABLE 1

| No. | a (mm) | b (mm) | c (mm) | Cutting direction | Oxidation free ratio (%) | Evaluation |
|---|---|---|---|---|---|---|
| 1 | 0.6 | 0.6 | 1.0 | Case A | 30 | Poor |
| 2 | 0.4 | 0.7 | 1.0 | Case A | 35 | Poor |
| 3 | 0.6 | 0.6 | 1.0 | Case B | 75 | Excellent |
| 4 | 0.4 | 0.7 | 1.0 | Case B | 80 | Excellent |
| 5 | 0.8 | 0.6 | 1.5 | Case B | 75 | Excellent |
| 6 | 0.6 | 0.8 | 1.5 | Case B | 90 | Excellent |

As shown in Table 1, the samples (Samples 1 and 2) having ground-electrode side tips obtained in Case A were found to be slightly poor in welding strength. Conceivably, these samples have poor welding strength for the following reason. The burrs formed on the reference surface of the ground-electrode-side tip hindered the close contact between the ground electrode and the ground-electrode-side tip at the time of resistance-welding. Thus, the fusion zone had a portion where the metal constituting the ground electrode and the metal constituting the ground-electrode-side tip did not fuse together to a sufficient degree.

In contrast, the samples (Samples 3 to 6) having ground-electrode-side tips obtained in Case B were found to be excellent in welding strength. Conceivably, these samples have excellent welding strength for the following reason. Since no burr was present on the reference surface of the ground-electrode-side tip, the degree of close contact between the ground electrode and the ground-electrode-side tip increased at the time of resistance-welding. Thus, over the entire fusion zone, the metal constituting the ground electrode and the metal constituting the ground-electrode-side tip fused together to a sufficient degree.

The results of the above-described test reveal that, in order to improve the joint strength between the ground-electrode-side tip and the ground electrode, in the tip forming step, a wire rod is desirably cut to obtain a tip by moving a cutting blade from one edge of the reference surface (serving as a joining surface) with respect to the width direction thereof toward the other edge of the reference surface with respect to the width direction.

Next, for each of ground-electrode-side tips differing from one another in terms of lengths of three edges a, b, and c, 1000 samples were prepared. The prepared samples were put in a production line so as to check whether or not a predetermined parts feeder can correctly or accurately identify a predetermined surface (e.g., a surface defined by the edges b and c) of the surfaces of the ground-electrode-side tip. Samples whose predetermined surfaces were correctly identified were counted, and the ratio (identification ratio) of the number of samples whose predetermined surfaces were correctly identified to the total number of the samples was calculated. Samples whose identification ratios were 100% were evaluated "Acceptable" because the parts feeder can correctly identify the reference surface from the surfaces of the ground-electrode-side tip, and the burr-free surface can be joined to the ground electrode more reliably. Meanwhile, samples whose identification ratios were not 100% were evaluated "Unacceptable" because a surface having burrs may be erroneously joined to the ground electrode. Table 2 shows the results of this test.

TABLE 2

| No. | a (mm) | b (mm) | c (mm) | Identification ratio(%) | Evaluation |
|---|---|---|---|---|---|
| 11 | 0.80 | 0.75 | 0.74 | 34 | Unacceptable |
| 12 | 0.80 | 0.75 | 0.71 | 97 | Unacceptable |
| 13 | 0.80 | 0.85 | 0.75 | 100 | Acceptable |
| 14 | 0.60 | 0.70 | 0.50 | 100 | Acceptable |
| 15 | 0.65 | 0.80 | 0.50 | 100 | Acceptable |

As shown in Table 2, it was found that each of the samples (Samples 13 to 15) having a difference of 0.05 mm or greater in length among the edges a, b, and c has an identification ratio of 100%, which allows correct identification of the reference surface of the ground-electrode-side tip.

The results of the above-described test reveal that, in order to enable the reference surface of the ground-electrode-side tip to be identified more accurately and enable a burr-free surface to be joined to the ground electrode more reliably, the difference in length among the edges of the ground-electrode-side tip is desirably set to 0.05 mm or greater.

The present invention is not limited to the above-described embodiment, but may be embodied, for example, as follows. Of course, applications and modifications other than those described below are also possible.

Figure 9:
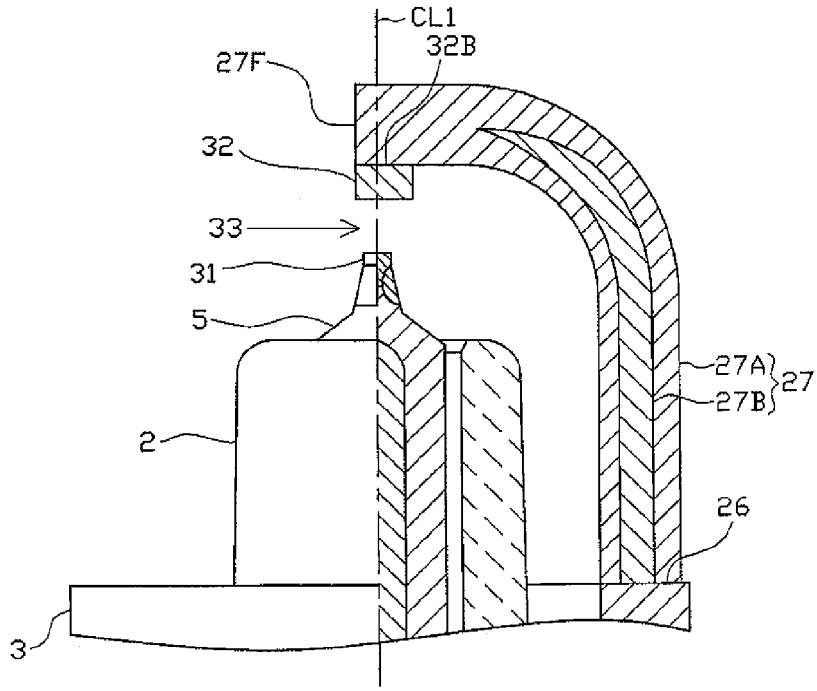
FIG. 9 is a partially sectioned, enlarged front view showing the configuration of a spark plug according to another embodiment.
Figure 10:
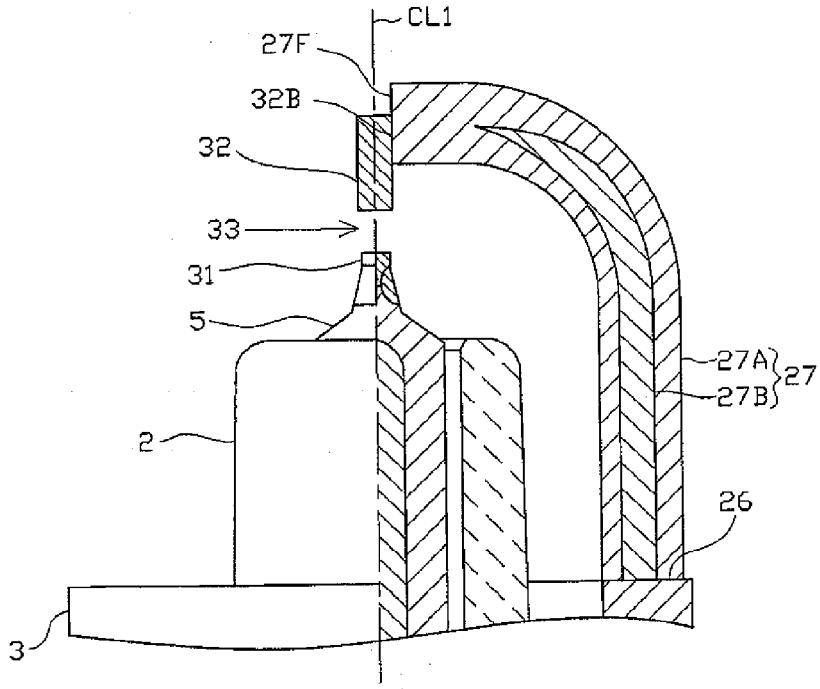
FIG. 10 is a partially sectioned, enlarged front view showing the configuration of a spark plug according to another embodiment.

(a) In the embodiment described above, the ground-electrode-side tip 32 projects from the distal end surface 27F of the ground electrode 27. However, as shown in FIG. 9, the ground-electrode-side tip 32 may be disposed such that it does not project from the distal end surface 27F of the ground electrode 27. Also, as shown in FIG. 10, a portion of the reference surface BS of the ground-electrode-side tip 32 may be joined to the distal end surface 27F of the ground electrode 27.

Figure 11:
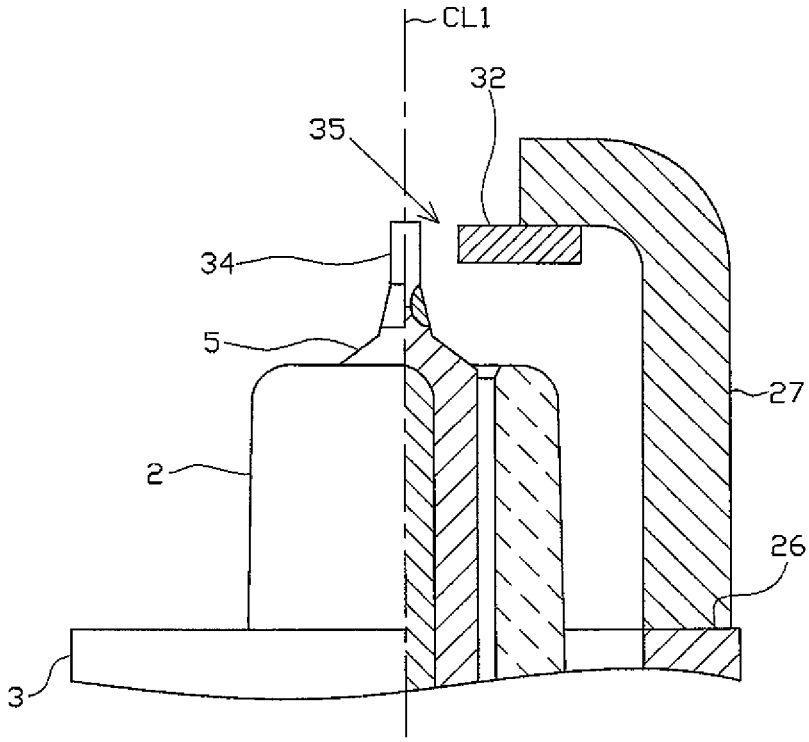
FIG. 11 is a partially sectioned, enlarged front view showing the configuration of a spark plug according to another embodiment.

(b) In the embodiment described above, the ground-electrode-side tip 32 faces the front end surface of the center electrode 5 (the center-electrode-side tip 31) so that spark discharge occurs at the spark discharge gap 33 in a direction approximately parallel to the axis CL1. However, the embodiment may be modified such that, as shown in FIG. 11, the ground-electrode-side tip 32 faces the side surface of the center electrode 5 (a center-electrode-side tip 34) so that spark discharge occurs at a spark discharge gap 35 in a direction approximately perpendicular to the axis CL1. In this case, by means of rendering the length of the edges 32X and the length of the edges 32Z different from each other as in the above-described embodiment, the direction of the ground-electrode-side tip 32 at the time of welding can be adjusted on the basis of the lengths of the edges. Thus, it becomes possible to more reliably dispose the ground-electrode-side tip 32 such that the burrs BR are not present on the side toward the spark discharge gap 35. As a result, it becomes possible to more reliably prevent occurrence of a situation in which ignition performance varies among spark plugs.

(c) In the embodiment described above, the ground electrode 27 is joined to the front end 26 of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(d) In the embodiment described above, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005 (E)] or the like.

DESCRIPTION OF REFERENCE NUMERALS

1: spark plug,
2: insulator,
3: metallic shell,
27: ground electrode,
32: ground-electrode-side tip (tip),
32B: joining surface,
33: spark discharge gap (gap),
BS: reference surface,
CE: cutting blade,
CL1: axis,
WR: wire rod.

Having described the invention, the following is claimed:

1. A method of manufacturing a spark plug comprising:

a center electrode extending in a direction of an axis;

a tubular insulator provided around the center electrode;

a tubular metallic shell provided around the insulator;

a rodlike ground electrode joined to a front end portion of the metallic shell; and a tip joined to the ground electrode through a joining surface of the tip, the tip forming a gap between the tip and a front end portion of the center electrode, the method being characterized by comprising a tip forming step of forming the tip, and a tip joining step of resistance-welding the tip to the ground electrode, wherein the tip forming step includes:

a wire rod forming step of forming a wire rod which is formed of the same metal as that of the tip, which has a rectangular cross section, and which has a reference surface on its side surface, and a wire rod cutting step of cutting the wire rod by moving a predetermined cutting blade from one edge of the reference surface with respect to a width direction thereof toward the other edge of the reference surface with respect to the width direction, to thereby obtain the tip, wherein in the tip joining step, at least a portion of the reference surface of the tip is joined to the ground electrode, whereby the portion of the reference surface becomes the joining surface.

2. A method of manufacturing a spark plug according to claim 1, wherein the tip has a rectangular cross section whose two edges have a length different from that of the remaining edges.

3. A method of manufacturing a spark plug according to claim 1, wherein the tip has a shape of a rectangular parallelepiped, and, in the wire rod cutting step, the wire rod is cut such that edges perpendicular to the cross section have a length different from the width of the reference surface.

4. A method of manufacturing a spark plug according to claim 2, wherein the tip is formed such that, of the four edges of the cross section, two edges having a length equal to the width of the reference surface are longer than the remaining edges.

5. A method of manufacturing a spark plug according to claim 1, wherein the tip has a shape of a rectangular parallelepiped, and the difference in length among the edges is equal to or greater than 0.05 mm.

6. A method of manufacturing a spark plug according to claim 1, wherein, in the tip joining step, a portion of the reference surface of the tip is joined to the ground electrode in a state in which the tip projects from a distal end of the ground electrode in a longitudinal direction of the ground electrode.

* * * * *